US005727725A

United States Patent [19]

Paskvich

[11] Patent Number: 5,727,725

[45] Date of Patent: Mar. 17, 1998

[54] FAN-FOLD PAPER STACKING RECEPTACLE WITH ANGLED BOTTOM AND CANTED BACK WALL

[75] Inventor: William J. Paskvich, Waynesboro, Va.

[73] Assignee: Genicom Corporation, Waynesboro, Va.

[21] Appl. No.: 735,256

[22] Filed: Oct. 22, 1996

[51] Int. Cl.[6] ..... B41J 11/26; B41L 1/32; B65H 57/00

[52] U.S. Cl. ..... 226/200; 206/494; 242/615; 270/39.01; 270/39.05; 400/613.2

[58] Field of Search ..... 226/196, 200; 242/615, 615.3; 270/39.01, 39.05; 312/34.4, 34.5; 400/613.2; 206/494, 499

[56] References Cited

U.S. PATENT DOCUMENTS

| | | | |
|---|---|---|---|
| 2,016,539 | 10/1935 | Brenn | 493/410 |
| 3,514,096 | 5/1970 | Muller | 493/413 |
| 4,631,552 | 12/1986 | Kobayashi | 400/613.2 X |
| 4,696,591 | 9/1987 | Boyden | 400/613.2 |
| 4,707,156 | 11/1987 | Clark | 400/613.2 |
| 4,749,295 | 6/1988 | Bankier et al. | 400/613.2 |
| 4,828,118 | 5/1989 | Dearien, Jr. . | |
| 4,923,188 | 5/1990 | Neir | 270/39.01 |
| 4,938,447 | 7/1990 | Schriner . | |
| 5,123,894 | 6/1992 | Bergeman et al. | 400/613.2 X |
| 5,363,998 | 11/1994 | Tschiderer | 400/613.2 X |
| 5,603,683 | 2/1997 | Lee et al. | 400/613.2 X |

*Primary Examiner*—Michael Mansen
*Attorney, Agent, or Firm*—Nixon & Vanderhye P.C.

[57] ABSTRACT

A container for stacking continuous web, fan-fold paper and a paper guide assembly are disclosed. The container has a contoured bottom that includes an extended center section which is slopped, a toe section at the lower end of the center section, and a crest and fan-fold shelf at the upper end of the center section of the bottom of the container. The center section is slopped sufficiently to cause the sheets of the continuous web of printed paper to slide downward to the toe section of the container and thereby become aligned with the stack forming in the container. The toe is aligned with the paper guide assembly that is an abutment against which an edge of the paper stack forms. The crease in the bottom of the container causes the paper to fold to reduce the tendency of the web to bulge. The paper guide assembly guides the paper as it falls from the printer chute output into the container.

8 Claims, 3 Drawing Sheets

FAN-FOLD PAPER STACKING RECEPTACLE WITH ANGLED BOTTOM AND CANTED BACK WALL

FIELD OF THE INVENTION

This invention relates to fan-fold paper stacking devices and, in particular, to receptacles for stacking large numbers of fan-folded sheets.

BACKGROUND AND SUMMARY OF THE INVENTION

Continuous sheets of fan-fold computer paper are routinely fed through high-speed printers, especially impart printers, in many applications. Businesses point sheets of forms, invoices, records, mailers and a variety of other documents on continuous fan-fold paper. The fan-fold paper is segmented into sheets by perforated transceiver lines. The sheets may have lengths of standard business letter (11 inch) legal (14 inch) or other length depending on the application of the paper. Fan-fold computer printer paper has been used for decades with high speed impact printers. Orderly slacks of fan-fold paper, often still in the shipping cartons, are fed as a continuous web of connected sheets through a printer. The sheets remain as part of a continuous web as they pass through the printer. The web exits the printer as a paper ribbon and drops to a receptacle. A problem that has plagued the high-volume, high-speed printer art is how to automate the stacking of printed continuous web paper in a large stack of fan-folded sheets.

Receptacles for receiving the printed web from the printer have been a variety of cartons, racks and wire cages with mechanical devices for folding the paper. These prior receptacles were costly mechanisms and/or have not reliably caught the printed web, folded the web along the fan-fold lines and stacked the web. There are receptacles that can handle small numbers of sheets, such as less than one-hundred sheets. However, receptacles for receiving large number of sheets, such as greater than a thousand, have not performed reliably. Many printer applications print thousands of sheets of fan-fold paper. In the past, operators had to manually monitor the stacking of printed sheets and regularly change the stack to ensure that the printed sheets did not become a tangled mess. Many times printing must stop when the printed fan-fold paper is restacked in the receptacle.

The printer downtime associated with restacking the printed fan-fold sheets and the operator costs for restacking results in a substantial cost to a print shop. These costs could be reduced significantly if a non-mechanical fan-fold paper receptacle could catch the printed sheets, fold the sheets along the fan-fold lines and stack the folded paper. In view of the cost savings to be gained by a non-mechanical reliable fan-fold stacker and the long-standing need for a better stacker, there has been a long-felt but unfulfilled need for a non-mechanical fan-fold stacker capable of handling large volumes of sheets for high speed continuous printing operations.

SUMMARY OF THE INVENTION

A novel and unobvious fan-fold paper stacker as part of a printer or, stand-alone in operation with a printer, has been developed capable of stacking thousands of sheets of fan-fold paper. This stacker has been proven to stack paper output from a high-speed continuous web (fan-fold) printer without the need for a human operator to adjust the stacker or the paper stack or otherwise attend the stacker as stacking proceeds. The stacker has demonstrated a surprisingly good performance as compared to prior containers used to catch printed continuous web paper.

The stacker in preferred embodiment, employs a fold bar or lip of a sheet guide, curved paper guide, and vertical railing assembly, which is the backside of the stacker. The stacker is fixed or set at the output side of a printer or print mechanism to collect the printed paper. The paper folding process is begun when the paper moves across a smooth bar or lip at paper entry to the container and touches the paper guide assuring that the folds contain no pucker. A paper fold in the fan-fold (printed web) then contacts the rail assembly which guides a fold edge of the web of sheets downward from the paper guide behind the printer. As the continuous printed web of fan-fold printer paper exits the printer, the paper tends to buckle (fold) along the perforated transverse fold lines between each sheet of the web. The buckling forms fold-edges in the web. The paper web, as it falls from the printer into the container, can be seen as having a zig-zag shape when viewed from the edge. The fold edges extend alternately towards and away from the printer. The fold edges extending away from the printer slide down the vertical rail assembly towards the stacker bottom. The vertical rail acts as a guide for the fold-edges, and hence the web as it drops into the stacker container.

A lower section of the railing assembly is sloped outward from a vertical line extending from the printer output. The fold edge of the paper sliding down the railing assembly follows the slope of the lower section of the assembly. The fold is pushed toward the railing assembly by gravity and its connection to or hinge of the previous fold which is away from the railing assembly. The sheet just behind this fold then stars to fall away from the rail assembly toward the printer making the zig-zag shape and causing the sheets to fall to a horizontal orientation. Accordingly, the railing assembly assists the printed web to fold, turn its sheets to horizontal, and align the folded sheets with the paper stack forming in the container.

The container of the stacker is especially adapted to receive the failing fan-fold printed paper web and stack the web in a fan-fold fashion. The bottom of the container is serpentine in cross-section to facilitate the stacking of the fan-folded sheets of printed paper. In particular, a center section of the bottom, having a width corresponding to the width of the paper web and a length at least one-half of a sheet in the paper web is sloped at an angle greater than the angle of friction between the sheets. The angle of friction is the angle at which two sheets of the paper must be tilted such that the force of gravity is just enough to overcome the friction between the sheets and cause the top sheet to slide over the bottom sheet. The slope of the center section of the bottom of the container causes the top paper sheets connected at the fold on the stack in the container to slide down towards the rail assembly and thereby align with the stack forming in the container. The paper fold at the rail assembly is compressed as the paper slides and wedges into the angle formed by the rail assembly and the sloped toe section described next.

The bottom of the container also has a toe section between the center section and the rail assembly. The toe section can be varied from flat to upwardly sloping. The toe section, adjacent to the rail assembly is aligned with the lower end of the rail assembly. The paper sheets sliding down the center section of the bottom of the container, stop sliding in the toe section as the sheets abut against the rail assembly. The toe section causes the paper to curve using a length (varying with slope) of each bottom sheet from the fold at the rail assembly. The curving of the paper allows flat compression of the fold edge at the rail assembly which would otherwise tend to bulge and cause the paper to fan toward the stack's vertical center line.

The container bottom has a crest ridge at the upper side (opposite to the toe) of the center section. When longer sheets of paper are used (those sheets substantially longer than the center section of the bottom) they overlap and fold over the crest ridge. The side of the crest ridge opposite to the center section, has a shallow slope downward from the crest away from the center and toward the printer. This slope or fan-fold shelf supports the front edge of the paper stack that is folded over the crest. In addition, the slope of the fan-fold shelf allows more folds and hence more sheets to accumulate which are not tightly folded and tend to fan toward the stacks vertical centerline. The bottom fold is compressed by succeeding sheets which are each incrementally shifted forward beyond the previous fold edge at the front of the stacker opposite the rail assembly. The shifting of each sheet causes prior folds to support the weight of increasingly longer sections of succeeding sheets. The result is that the bottom fold is compressed flat. Succeeding folds are compressed flat as the stack increases in height following the angle of the rail assembly which controls the rate at which the weight shifts over previously folded sheets. This ongoing compression of folds is what prevents the fanning of folds toward the vertical centerline of the stack at the front of the stack.

In summary, the paper is aligned and guided to the bottom of the container. Placed in neat stack and compressed folds which is slightly canted toward the printer at the angle of the rail assembly.

DETAILED DESCRIPTION OF THE DRAWINGS

Figure 1:
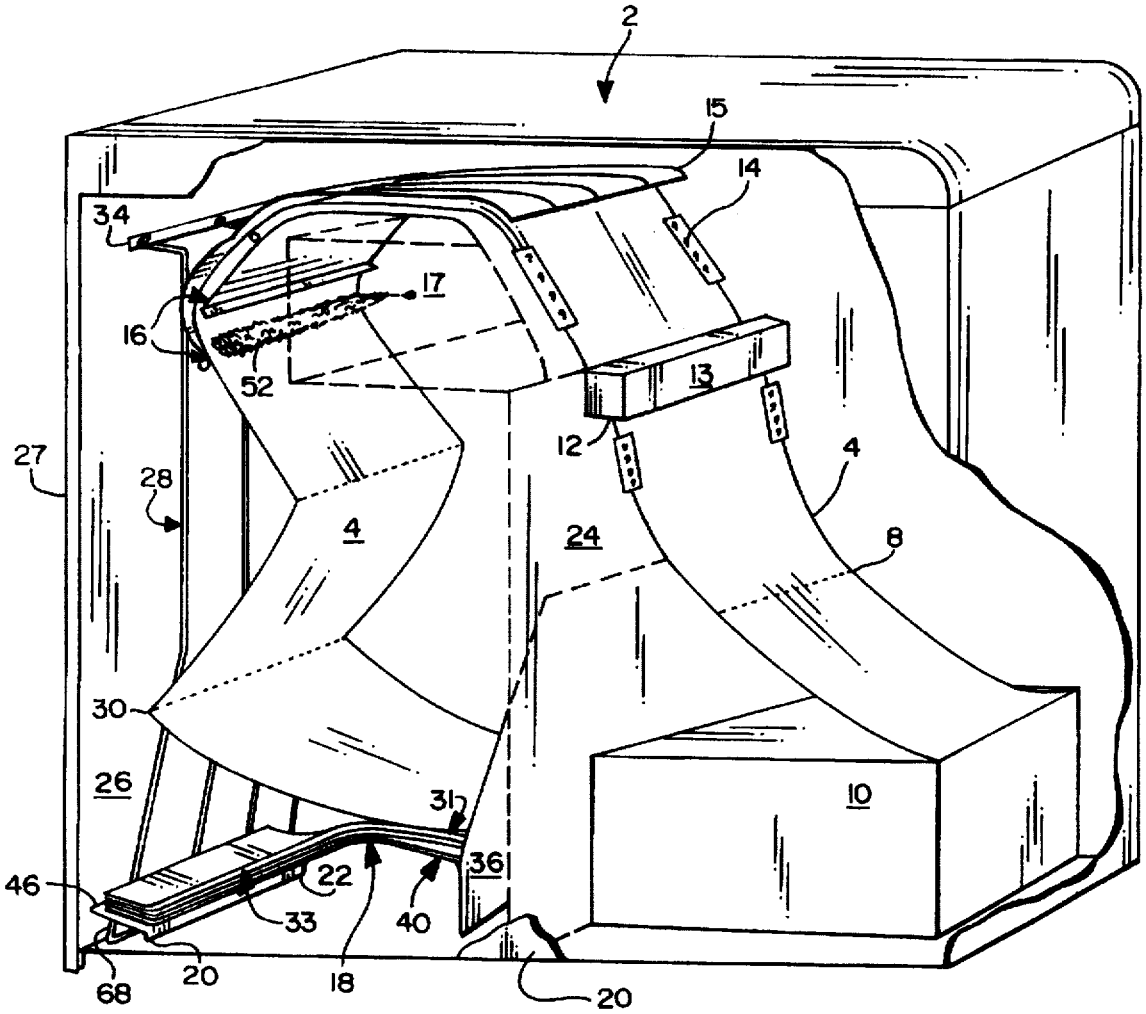
FIG. 1 is a perspective view of a printer with a continuous web paper supply, an attached paper rail guide assembly and a printed paper stack container.

FIG. 1 shows a high-speed printer 2 printing on a continuous web of computer paper 4. The web 4 is segmented into sheets 6 by perforated lines 8 which form fold lines in the web. The sheets of the web fold in a zig-zag pattern along the perforated lines. A long web of blank computer paper sheets, folded in a zig-zag pattern, is stacked in a paper supply container 10 (either within or outside the printer) such that the sheets of the web lie one on top of the other with the fold (perforated) lines at opposite edges of the sheet. Before the printer commences printing, the paper web 4 is inserted into a paper inlet 12 of the print head 13 of the printer.

The printer 2 may have a web drive mechanism with tractor drive gears 14 that pull the paper web from the supply container and move the web through a paper path chute 15 by engaging the teeth from the tractor gears with holes (not shown) in the side edges of the web. The printer paper drive mechanism, represented by tractor gears 14, move the web from the paper supply container 10 through the printer 2 and out an output 16 of the printer chute 15. The pointer may have a variety of the conventional components, e.g., electronic circuitry 17.

As the web moves through the printer, the paper imprints text and graphics onto the sheet. The web is moved in a continuous fashion from the supply container, through the printer and out the printer output. The continuous web sheet output from the printer is stacked in a stacker receptacle 18 below the chute output 16.

The printer chute 15 (FIG. 1) may alternately include a pair of rollers or parallel bars (not shown) at output 16 to keep the paper as it exits the printer chute in alignment and prevent the paper from puckering along the perforations while exiting the paper guide chute 15. In addition, the paper guide chute may include a mechanism for dissipating any static electricity on the paper. For, example, a static brush or other edge 52 at the exit 16 of the paper guide chute may dissipate static charges. The brush 52 may be grounded or connected to an electric potential opposite to the static charge on the paper. At the brush 52 the static electric field on the paper is dissipated by its proximity to the brush.

The edge lip 54 of the exit 16 to the paper guide chute 15 is reasonably close, such as within 2 to 3 inches, to the guide rail assembly 28 and is positioned directly over the stacker container 18. As the paper web 4 exits the trailing edge 54 (FIG. 2) of the printer paper guide, the web falls downward into the stacker receptacle 18. As the paper falls, it tends to buckle and fold along the perforation lines to form a zig-zag pattern. As the paper nears the stacker, the upward resistance from the sheets that have already landed onto the paper slack causes the falling sheets to buckle and fold further. As the falling sheets fold, the fold-edges 30, 31 alternately protrude towards 30 the printer and away from 31 the printer. The fold-edges 30 protruding away from the printer 13 abut the rail assembly 28 and slide down that assembly as the paper web falls into the stacker container 18.

In FIG. 1, a left side 20 of the printer is shown as a cut-a-way for illustrative purposes to reveal the interior structure of the printer. The stacker container 18 receives the continuous web 4 output from the printer chute 15 and causes the web to stack in a zig-zag fan-fold fashion one sheet over the other. Once printing is completed, the stacked web is removed from the stacker container 18 as a stack of fan-fold printed sheets still connected in a continuous web. The sheets may be used for further processing, such as to be assembled with other sheets into a business form, or split from a continuous web into individual printed sheets. The stacker receptacle 18 has a front side 24 and a back side 26. The front side 24 of the stacker 18 is positioned adjacent the paper supply 10, and may be positioned elsewhere, such as if the stacker 18 is external to the printer. The back side 26 is aligned with the paper railing assembly 28 attached to the back door 27 of the printer.

The paper railing assembly 28 in the exemplary embodiment is formed of four vertical rails that form a back stop to the web dropping from the printer chute 15 into the stacker container 18. As the printed paper web drops from the printer chute output 16, alternate perforated lines in the web fold the web and the edges 30 formed by the folded web slide downward against the rail assembly 28. The rail assembly guides the web downward into the stacker container by acting as a backstop guide rail to the folded edges 30 of the paper web. At its upper portion, the rail assembly is substantially vertical and guides the web vertically downward. The rail assembly also maintains the edge 30 of the paper in a parallel orientation to the rail assembly, which assists in aligning the web as it falls into the container. The rail assembly has a backward slanted lower portion 32 that guides the web into the stacker assembly 18. The lower portion slants back from vertical at an angle, such as 12°, away from a vertical line extending down from the printer paper output 16.

Figure 2:
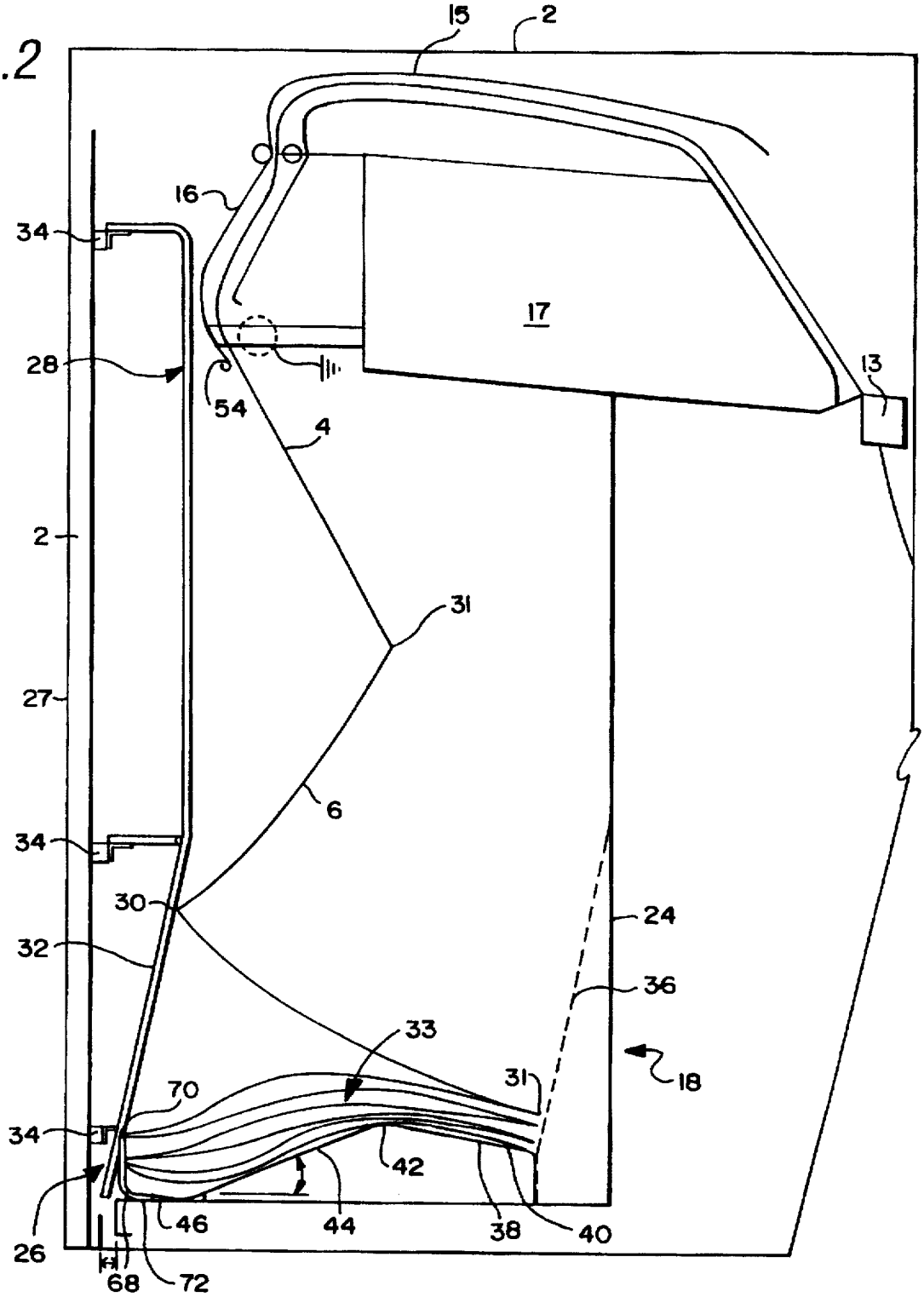
FIG. 2 is a cross-sectional view of the stack container and the paper output side of the printer with rail guide assembly shown in FIG. 1.
Figure 3:
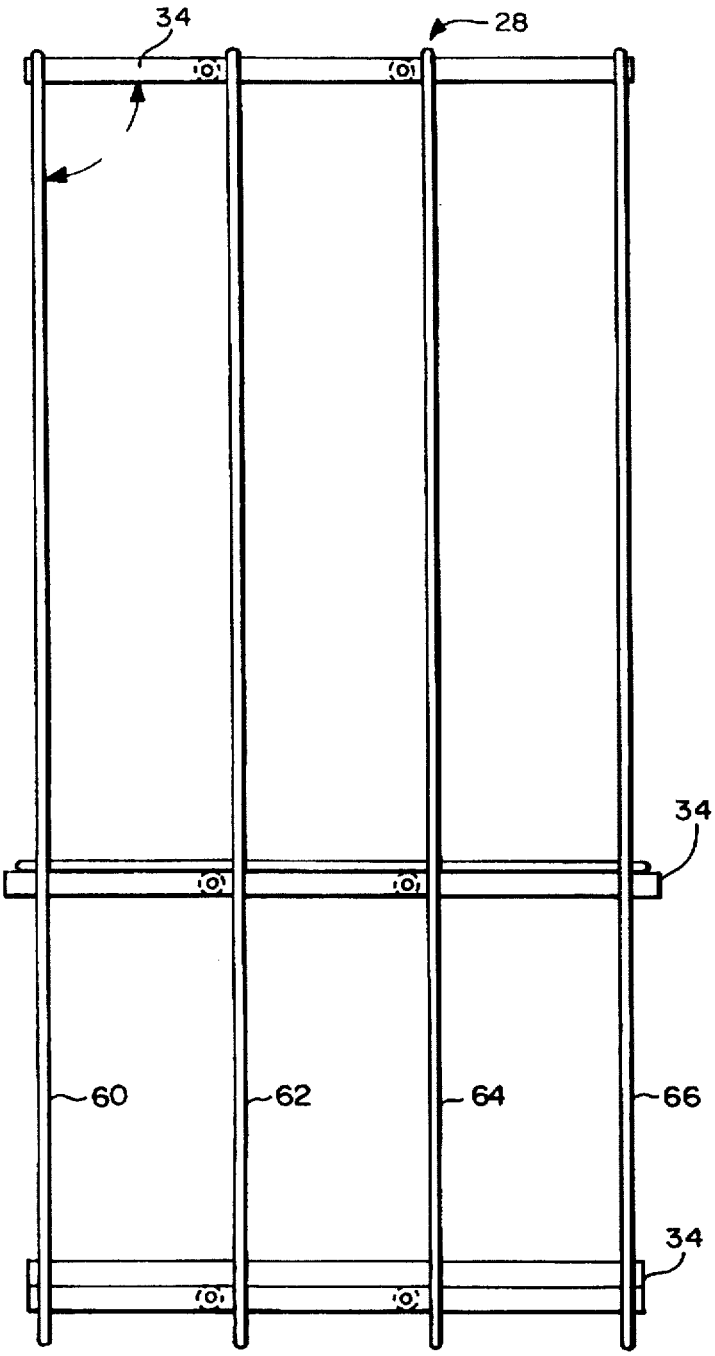
FIG. 3 is a front view of the paper rail guide assembly shown in FIG. 1.
Figure 4:
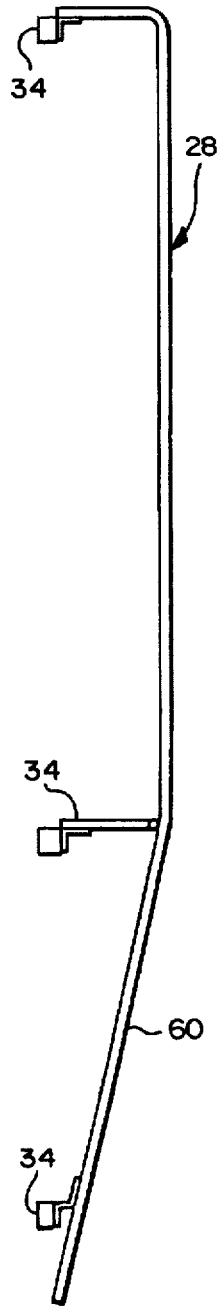
FIG. 4 is a left side view of the paper rail guide assembly shown in FIG. 3.

As shown in FIGS. 2 to 4, the rail assembly 28 is affixed by brackets 34 to the door 27 of the printer 2. The number of vertical comprising the rail assembly 28 will vary with printers. In the disclosed embodiment there are four vertical rails 60, 62, 64, 66 used as a guide for the continuous web exiting from the printer chute output 16. Alternatively, the paper web guide may be formed of components other than railings, such as solid walls that perform the same function and in an equivalent manner of providing a guide for the fold-edges 30 of the continuous paper web 4 dropping from the printer output 16 into the stacker receptacle 18. The guide rails 60, 62, 64 and 66 may be metallic.

The buckling (folding) of the web dropping from the printer chute output 16 causes the fold-edges 30 to extend towards the rail assembly. Relatively soon after the paper leaves the printer paper output 16, the fold-edges 30 of the paper web contact and begin sliding against the rail guide assembly 28. The rail guide assembly guides the edge 30 of the paper downward into the stacker container 18. By guiding the fold-edges 30, the rail assembly guides the entire web into the stacker container and aligns the web with respect to the paper stack 33 forming in the container. Facilitating the contact between the edge 30 of the paper and the rail assembly 28 is a small electrostatic force between the paper and the metal rail guide assembly. This light natural electrostatic force pulls the fold 30 of the paper against the rail, and helps maintain contact between the edge 30 and the rail assembly as the web falls into the stacker receptacle.

The rail guide assembly 28 maintains the free-falling web 4 in vertical alignment with the stacker receptacle 18. As the fold-edges 30 of the paper slide downward along the rail guide assembly 28, the edges follow the slope of the lower section 32 of the rail guide assembly. As the fold-edges 30 follow the slope of the lower section 32, the sheets 6 of the web are pushed towards the backside 26 of the stacker receptacle. The force of the sheets immediately below each fold-edge 30 tends to push the edge against the rail assembly due to its connection to those sheets, gravity and/or air pressure. Because fold-edges 30 follow the slope of the lower section 32 of the rail assembly, the sheets of the web are also turned from a vertical orientation to a horizontal orientation parallel to the stack 33 in the stacker container.

The stacker receptacle 18 (FIG. 2) has a slanted front wall 36 that is backwardly angled, such as about 12°, to accommodate the front fold-edges 31 (the back fold-edges are edges 30) of the printed paper stack. The bottom floor 38 of the stacker receptacle 18 is configured to facilitate stacking of the continuous web 4. The bottom floor 38 is contoured to have a serpentine cross-sectional shape, such as is shown in FIG. 2, to cause the paper stacker to slide down a slope in the bottom and abut against the backside of the container, and to reduce the tendency of the fan-fold stack to bow up at the edges due to the fan-folding. The front section 40 of the bottom floor 38 has a shallow slope to cause the sheets of the continuous web to fold over a crest ridge 42 in the bottom floor. The front section 40 of the bottom floor 38 has a relatively shallow slope, such as approximately 11°, from horizontal.

The bottom floor 38 of the stacker receptacle 18 includes a second (center) downwardly sloped section 44 that extends from the crest 42 (opposite to the first section) towards the back section 26 of the stacker receptacle. The slope of the second segment 44 of the bottom floor 38 extends a distance generally greater than one-half the length of a typical sheet 6 of the web. The slope from horizontal of the second section 44 of the bottom floor 38 is greater than the angle of friction between the sheet 6 of paper. For example, the slope of the second section may be 24° from horizontal. The angle of friction between the sheets of paper is the angle at which the sheets will begin to slide downward one over the other. By maintaining the angle from horizontal of the second section 44 of the bottom floor greater than the angle of friction, paper sheets falling onto the stack will slide down the slope of the second section 44 to a toe section 46 of the bottom floor 38.

The toe section 46 is a portion of the bottom floor between the center second section and the backside 26 of the stacker, and adjacent to the bottom section of the rail guide assembly 28. The toe section 46 may be horizontal or may be sloped upwardly slightly. The toe section causes the sheets of paper to stop sliding after they have slid down the section sloped section 44 and abutted against the bottom section of the rail assembly 28. The weight of the stack of paper forming in the container is partially directed onto the toe to compress the edges of the web of the toe. The toe section 46 may be formed of a pivotable toe channel extending between the left and right sides 20, 22 of the receptacle 18. The toe channel includes a center prop 68 attached to the toe. As shown in FIG. 1, the toe channel is rotated and propped to change the angle of the toe to the rail assembly 28.

As the sheets 6 of paper fall one on top of the stack 33, the sheets tend to conform to the contoured shape of the bottom floor 38 of the stacker receptacle 18. Since the second section 44 of the bottom floor is the longest section of the bottom floor, the paper will tend to slide down the slope of the stack 33 corresponding to the second section 44. The sliding of sheets may be only a few inches, but the sliding aligns the back fold-edge 30 of each sheet with the back edge of the paper stack 33 abutting against the rail guide assembly 28. In addition, the sliding of the paper sheets 6 down the slope surface 44 will tend to cause the air between the folding sheets to escape and allow further compression of the stack forming in the stack receptacle 18. Moreover, lowering the air pressure in the stacker receptacle 18 enhances faster paper stacking.

The web 4 drops into the receptacle 18 in a zig-zag stacking pattern of folded sheets 6 to form a relatively uniform and orderly stack 33 of paper. While the paper sheets are guided by the rail assembly 28 to the paper stack, the downward sliding of the folding sheets of paper along the slope 44 on the floor causes the fold-edges 30 of the paper to align against the rail assembly 28 to form a neat and straight paper stack in the stack receptacle.

Because the lower section 32 of the rail assembly is slightly canted the fold-edges 30 of the sheets 6 (which abut against the rail assembly) are each set back slightly from the preceding edge. This slight set-back in the overlapping edges reduces the direct overlap of folded edges and hence reduces the tendency of a fan-folded stack 33 to bulge at its front and rear edges. In addition, the tendency of the folded edges 30, 31 to bulge in the stack is reduced at the backside 26 of the stacker by the toe 46 at the bottom floor of the stacker. The edges of the paper tend to bend at the toe and compress one on top of the other as the sheets slide down slope 44 into the toe.

The front folds 31 of the sheets of the paper web are prevented from bulging upward by the first section (fan-fold shelf) 40 of the bottom 38 that causes longer sheet paper to fold over the crest ridge 42. As the papers fold over crest 42, the folded edges press down on lower folded edges to compress the stack. In addition, the folded edges are offset one over the other due to the slope of the lower section of the rail assembly 32. This offsetting of the edges of the paper tends to reduce the bulging upward of the stack 33. The offsetting of edges incrementally increases the vertical load that each prior and underlying fold must support. The front section 40 of the bottom allows a sufficient number of uncompressed folds to accumulate so that the vertical load can increase to a level where the bottom fold in the stack will compress and so the stack front edges 31 will not bulge up to prevent or hinder continued stacking.

The invention has been described in what is presently considered to be its preferred embodiment. The invention is not to be limited to its disclosed embodiment. Rather, the invention encompasses the various modifications, substitutions and equivalent arrangements included within the spirit and scope of the appended claims.

What is claimed is:

1. A continuous paper stacker and guide assembly for stacking a web of printed fan-fold paper, wherein the paper is segmented into sheets along fold lines, comprising:

a guide assembly having an upper vertical guide surface alignable with a paper output of a continuous feed printer, and a lower guide surface extending from the upper guide surface down towards a bottom surface of a container, wherein the lower guide surface slopes away from a vertical line extending through the paper output, and the container having the bottom surface, at least two side walls, a front wall and a back wall, wherein the back wall is alignable with the lower guide surface, and wherein the bottom surface includes a center section having a width at least as wide as the web and length at least one-half a length of a sheet in the web, the center section having a slope slightly greater than an angle of friction between the sheets of the web, where the slope of the bottom surface extends downward towards the lower guide surface, and the bottom surface includes an upwardly sloped toe shelf between the center section and the lower guide surface, wherein a valley is formed between the toe shelf and center section and the valley is substantially parallel to the fold lines of the sheets.

2. A continuous paper stacker and guide assembly as in claim 1, wherein the bottom surface of the container includes a crest at an upper end of the center section, and where the crest is substantially parallel to the fold lines of the sheets.

3. A continuous paper stacker and guide assembly as in claim 2, wherein the bottom surface of the container includes a fan-fold shelf adjacent the crest, and the shelf has a shallow slope downward from the crest.

4. A continuous paper stacker and guide assembly as in claim 1, wherein the toe shelf includes a pivotable hinge connection with the center section of the bottom surface.

5. A continuous paper stacker and guide assembly as in claim 1 wherein the guide assembly comprises a plurality of substantially vertical rails, and the rails form the upper and lower guide surfaces.

6. A continuous paper stacker and guide assembly as in claim 5 wherein the guide assembly comprises at least four metallic rails.

7. A continuous paper stacker and guide assembly as in claim 1 wherein the slope of the center section is approximately 24° from horizontal.

8. A continuous paper stacker and guide assembly as in claim 1 wherein the center section has a length at least one-half of a length of one of the sheets.

* * * * *